United States Patent [19]

Stahlecker

[11] Patent Number: 4,677,815

[45] Date of Patent: Jul. 7, 1987

[54] FRICTION ROLLER FOR OPEN-END FRICTION SPINNING

[75] Inventor: Fritz Stahlecker, Josef-Neidhart-Strasse 18, 7347 Bad Ueberkingen, Fed. Rep. of Germany

[73] Assignees: Hans Stahlecker; Fritz Stahlecker, both of Fed. Rep. of Germany

[21] Appl. No.: 836,748

[22] Filed: Mar. 6, 1986

[30] Foreign Application Priority Data

May 28, 1985 [DE] Fed. Rep. of Germany ..... 3519102

[51] Int. Cl.[4] ..... D01H 1/135; D02G 1/08

[52] U.S. Cl. ..... 57/401; 57/334

[58] Field of Search ..... 57/334, 400, 401

[56] References Cited

U.S. PATENT DOCUMENTS

| | | | |
|---|---|---|---|
| 511,878 | 1/1894 | Cupers | 57/401 X |
| 4,281,507 | 8/1981 | Didek et al. | 57/401 |
| 4,327,545 | 5/1982 | Fehrer | 57/401 X |
| 4,334,400 | 6/1982 | Fehrer | 57/401 X |
| 4,358,922 | 11/1982 | Feldstein | 57/401 |
| 4,420,928 | 12/1983 | Fehrer | 57/401 |
| 4,522,022 | 6/1985 | Parker | 57/401 |
| 4,522,023 | 6/1985 | Stahlecker | 57/401 |
| 4,562,694 | 1/1986 | Sumar | 57/334 X |

FOREIGN PATENT DOCUMENTS 3323189 1/1985 Fed. Rep. of Germany .

*Primary Examiner*—Donald Watkins
*Attorney, Agent, or Firm*—Barnes & Thornburg

[57] ABSTRACT

A friction roller for open end friction spinning and a method of making same are disclosed. The cover surface of the friction roller that imparts friction to fibers to form yarn in a yarn formation zone exhibits an outer surface texture which extends essentially in the longitudinal direction of the friction roller.

17 Claims, 11 Drawing Figures

Fig. 9
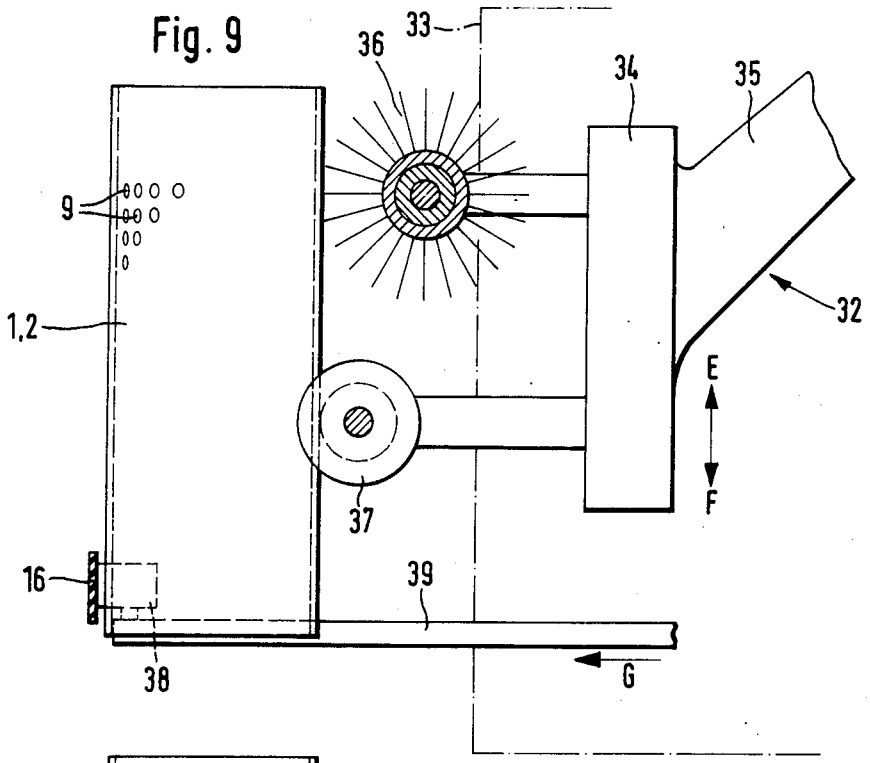
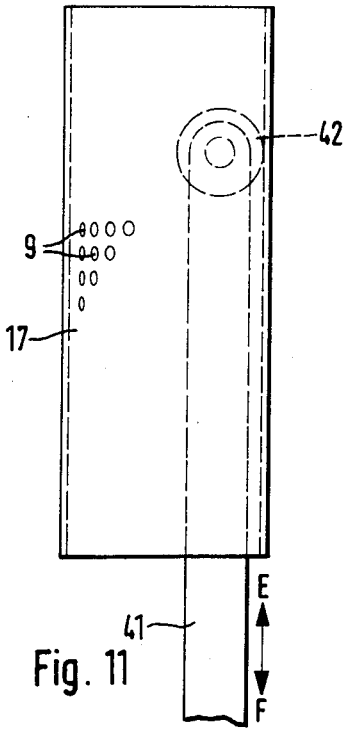
Fig. 11
Fig. 10
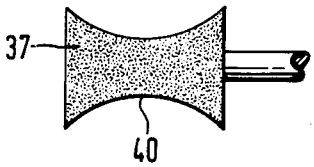

FRICTION ROLLER FOR OPEN-END FRICTION SPINNING

BACKGROUND AND SUMMARY OF THE INVENTION

The invention relates to a friction roller for a device for open-end friction spinning of the type which includes a cover surface that forms a yarn formation zone and in the region of this yarn formation zone exhibits an outer surface structure which deviates from the plane of rotation (concentric surface about the axis of rotation).

It is disclosed in German Published Unexamined Application DE-OS No. 33 23 189 to provide the cover surface of a friction roller with a spirally extending outer surface texture in which the areas between the respective textured regions are left respectively untextured. The spirally extending textured strips exhibit a very small inclination so that approximately a ring texture is achieved. These measures are disclosed as being for the purpose of attenuating the friction forces opposite the yarn withdrawal direction in the axial direction of the roller so that the danger of disconnection of the yarn tip is reduced.

The invention is based upon the problem to improve a friction roller of the above-mentioned kind so that a higher consistency in the spinning condition and the resulting spinning results is achieved.

This problem is solved according to preferred embodiments of the invention by providing that the roller yarn forming surface texture is aligned essentially in the longitudinal direction of the cover surface of the roller.

Practical tests have surprisingly shown that the friction rollers, which after a long spinning time are hardly capable of spinning because of changes in the surface in the region of the yarn formation zone, can be made to be further capable of acceptable spinning by means of an upper surface treatment so that a yarn forming surface texture is achieved which is aligned essentially in the longitudinal direction of the cover surface.

In further development of especially preferred embodiments of the invention it is provided that the outer surface texture is formed as a plurality of microchannels extending essentially in the longitudinal direction of the friction roller cover surface. It has been determined that these kind of microchannels, which are hardly visible with the naked eye, result in an essential improvement.

According to a first embodiment it is provided that the outer surface texture is formed as a spiral extending at a sharp or accute angle with respect to the longitudinal axis of the roller. A spiral shaped outer surface texture of this type is preferably made through a corresponding treatment whereby the more acute the angle between the longitudinal axis and the spiral is the more advantageous for the spinning results. According to a further preferred embodiment of the invention it is provided that the outer surface texture is aligned parallel to the longitudinal axis of the roller. It has been shown that with this form of aligned outer surface texture, the best results are achieved.

In further developments of the invention there is provided a process for preparing a friction roller in which the rollers, at least in the region of the yarn formation zone, are treated by a grinding and/or polishing and/or brushing treatment, which treatment is essentially aligned to the longitudinal direction of the roller. In order to achieve an outer surface structure in the form of microchannels aligned parallel to the longitudinal axis of the roller it is provided according to the further development of the invention that the rollers are stopped during the treatment and that the rollers are step-wise turned between the respective treatment steps, which treatment steps extend essentially in the longitudinal direction of the roller.

Further objects, features, and advantages of the present invention will become more apparent from the following description when taken with the accompanying drawings which show, for purposes of illustration only, an embodiment/several embodiments in accordance with the present invention.

BRIEF DESCRIPTION OF THE DRAWINGS

FIG. 9 is a schematic side view of a preferred embodiment of a device for making the outer surface texture at a friction roller for the embodiment according to FIGS. 1 and 2;

FIG. 10 is a partial view taken in a direction transverse to the view of FIG. 9 and showing a component of the arrangement according to FIG. 9; and FIG. 11 is a partial schematic view of a preferred embodiment of a device for making the surface texture at a friction roller for the embodiments according to FIGS. 3 and 4.

DETAILED DESCRIPTION OF THE DRAWINGS

Figure 1:
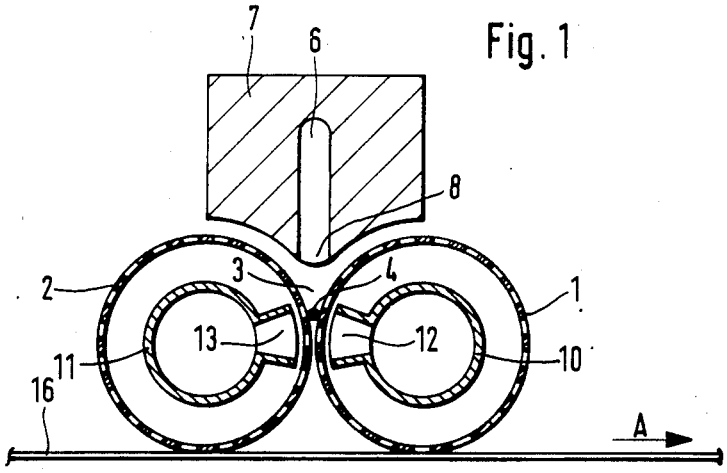
FIG. 1 is a schematic cross-sectional view through a part of an open-end friction spinning device with two friction rollers, the yarn forming surfaces of which rollers are textured in accordance with preferred embodiments of the present invention.
Figure 2:
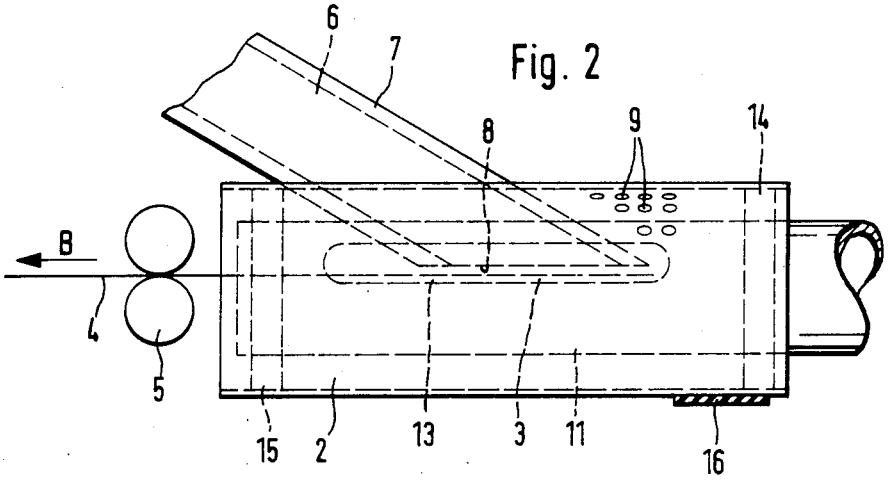
FIG. 2 is a schematic side view of the open-end spinning device of FIG. 1.

The device for open-end friction spinning shown in FIGS. 1 and 2 includes two adjacently arranged parallelly extending friction rollers 1 and 2 which together form a fiber receiving wedge gap 3 which serves as a yarn formation zone. In the wedge gap 3 the fibers thereto are twisted together to form a yarn 4, which yarn is withdrawn away from the roller pair by the withdrawal device 5 in the direction of the arrow B in the longitudinal direction of the wedge gap 3.

The fiber material to be spun is guided in the form of individual fibers via a fiber feed channel 6 to the region of the wedge slot 3. The fiber feed channel 6, which is arranged in a channel housing 7, is inclined against the withdrawal direction of B of the arm 4 at an acute angle to the wedge slot 3. The slot shaped mouth 8 of the fiber feed channel 8 extends essentially parallel to the wedge slot 3 at a close distance therefrom.

The individual fibers are guided to the wedge gap 3 in a transport air stream through the fiber feed channel 6. In order to create the transport air stream, or at least to support the same, an air stream is created in the wedge gap 3 that flows through the covers of the friction rollers 1 and 2. The covers of the friction rollers 1 and 2 are provided with perforations 9 which extend at least over the length of the slot shaped mouth 8 of the fiber feed channel 6. Suction inserts 10 and 11 are arranged respectively on the inside of the friction rollers 1 and 2, which suction inserts are connected to a not illustrated under pressure source and are aligned with their respective suction slots 12 and 13 facing the wedge gap 3. The suction slots 12 and 13 extend at least over the length of mouth 8. With this arrangement, a suction air flow is created which streams essentially out of the fiber feed channel 6 through the perforations 9 into the inside of the friction rollers 1 and 2. Via this air stream, the individual fibers are guided to the region of the wedge gap 3 and simultaneously the existing forming yarn 4 is securely held in the wedge gap 3.

The covers of the friction rollers 1 and 2 are borne respectively by means of roller bearings 14 and 15 directly at the suction inserts 10 and 11. They are driven in the same rotational direction by means of a tangential belt 16 which moves in the direction corresponding to arrow direction A and which engages both cover surfaces of rollers 1 and 2. The tangential belt 16 serves for the driving of several similarly arranged spinning devices or units which are arranged in a row adjacent to one another and belong to an open end friction spinning machine.

Figure 3:
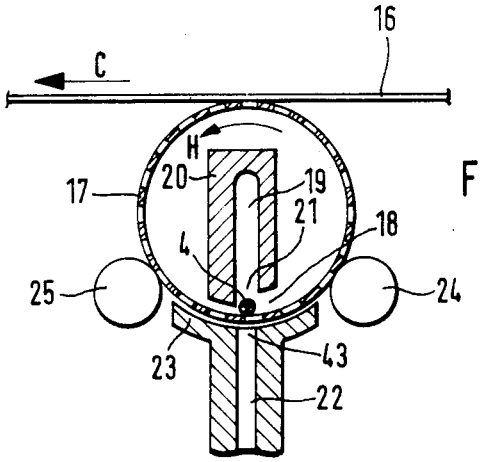
FIG. 3 is a schematic cross-sectional view through a part of a further embodiment of an open-end friction spinning device with a friction roller having the yarn formation zone formed on the inner surface, which inner surface yarn formation zone is textured in accordance with preferred embodiment of the present invention.
Figure 4:
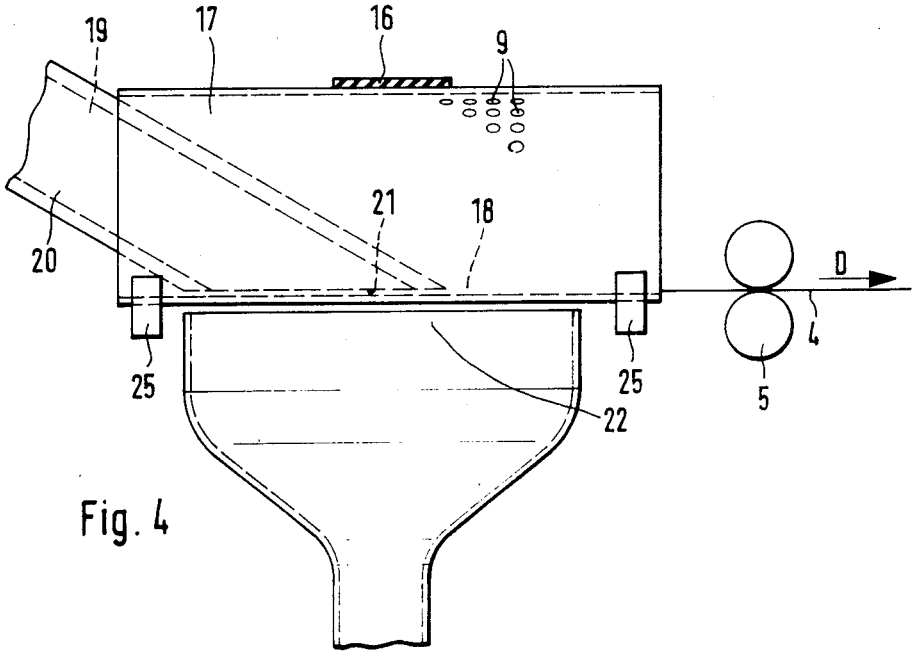
FIG. 4 is a schematic side view of the open-end friction spinning device according to FIG. 3.

The embodiment according to FIGS. 3 and 4 is constructed with a single friction roller 17, the cover of which is provided with perforations 9. With this device the inner surfaces of the cover serve as the yarn formation zone 18 which is disposed oppositely to mouth 21 of a fiber feed channel 19. The fiber feed channel 19 is a part of a channel housing 20 which is guided into the inside of the friction roller 17 through a side or end face thereof. The mouth 21 of the fiber channel 19 is formed with a slot shape and extends essentially in the longitudinal direction of a cover line (axially extending line along the radially inwardly facing surface of roller 17) of the friction roller 17. The friction roller 17 is driven by means of a tangential belt 16 moving in the direction of the arrow C, with resultant rotational movement in the direction of the arrow H. The friction roller 17 is borne in a wedge slot formed by support rollers 24 and 25, into which wedge slot it is pressed by means of the tangential belt 16.

A suction device 22 is arranged at the radially outer side of the friction roller 17. The mouth 21 of the fiber feed channel 19 is disposed oppositely of the suction device 22, which device 22 has a suction slot 43 aligned essentially parallel to the mouth 21 of the fiber feed channel 19. The suction slot 43 is longer in the yarn withdrawal direction side than the mouth 21 of the fiber feed channel 19, as depicted in FIG. 4 with arrow D depicting the yarn withdrawal direction.

The fed fibers are twisted together to form yarn 4 by means of the friction at the inner surface of the cover of the friction roller 17 and the effect of the air stream flowing out of the fiber feed channel 19 through the perforations 9 into the suction device 22. The channel housing 20 is formed in the region of the mouth so that the existing yarn 4 can not be clamped with the walls of the channel housing 20 (compare FIG. 3 channel mouth configuration vis a vis the rotational direction H). At the suction device 22, laterally spaced from the suction slot 43, sealing flanges 23 are provided which closely encompass the outer cover surface of the friction roller 17.

Tests have shown that the spinning results, especially with respect to the consistency of the yarn quality, are clearly improved if the yarn formation zone surfaces of the cover of the friction rollers 1 and 2 and 17 are provided with a yarn forming surface texture which extends in a longitudinal direction of the respective friction rollers 1, 2, 17. This type of surface texture is schematically illustrated in FIGS. 5–8. The surface structure or texture consists of microchannels with a depth of several hundreths of a millimeter which extends essentially parallel to one another and essentially in the longitudinal direction of the axes of the respective friction rollers 1, 2 and 17.

Figure 5:
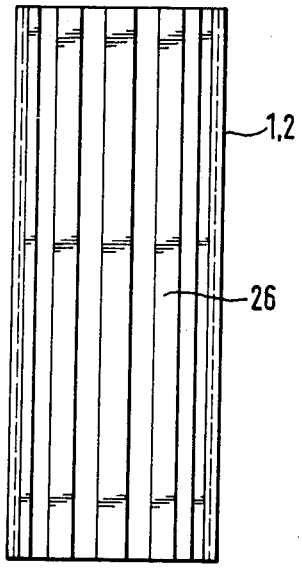
FIG. 5 is a schematic view of a cover surface of a friction roller for an open-end friction spinning device corresponding to FIGS. 1 or 2, and depicting a preferred embodiment of surface texture in accordance with the present invention.

In the embodiment according to FIG. 5, a stripped type outer surface 26 is disposed at the outer cover surface of the friction rollers 1 and 2, with strips extending parallel to the longitudinal axis of the friction rollers 1 and 2. The strips of the outer surface texture 26 exhibit respectively a width of at least five millimeters each.

Figure 6:
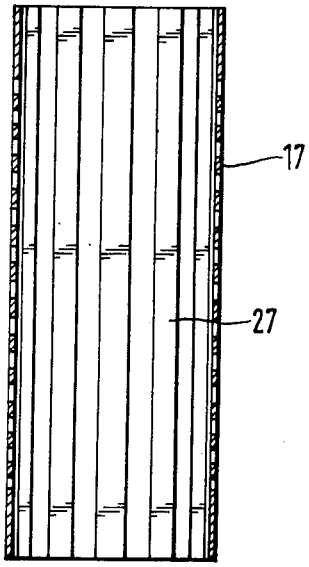
FIG. 6 is a schematic longitudinal sectional view through a roller for an open-end friction spinning device corresponding to FIGS. 3 and 4, and depicting a preferred embodiment of surface texture in accordance with the present invention.

According to the FIG. 6 embodiment, upper surface texture 27, corresponding to that of FIG. 5 embodiment, is disposed in the longitudinal direction with texture strips 27 at the inside of the cover of the friction roller 17. Also these surface texture strips 27 are formed as microchannels.

Figure 7:
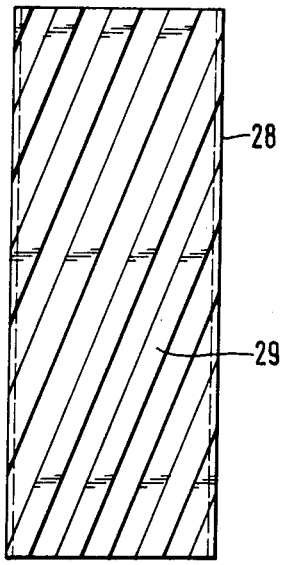
FIG. 7 is a schematic view of a cover surface of a friction roller for a spinning device corresponding to FIGS. 1 or 2, and depicting another preferred embodiment of surface texture in accordance with the present invention.

In FIG. 7 a friction roller 28 for the device according to FIGS. 1 and 2 is illustrated, the cover of which is provided at the surface with an outer surface texture 29 in the form of a steep spiral. The inclination of the spiral should not be greater than 30 degrees with respect to the longitudinal axis (axis along the cover parallel to the roller rotational axis) of the roller 28.

Figure 8:
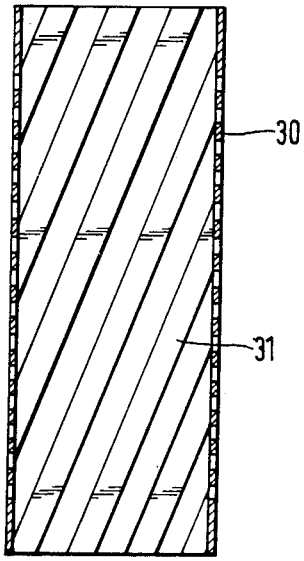
FIG. 8 is a schematic longitudinal sectional view through a roller for an open-end friction spinning device corresponding to FIGS. 3 and 4, and depicting another preferred embodiment of surface texture in accordance with the present invention.

In FIG. 8 a roller 30 for the device corresponding to FIGS. 3 and 4 is illustrated, the cover at the inner surface being provided with an upper surface texture 31 in the form of a steep spiral. Also these spirals should not exceed an inclination of 30 degrees with respect to the longitudinal axis of the friction roller 30. Also in the embodiments according to FIGS. 7 and 8, the upper surface textures 29 and 31 are formed as microchannels.

In modification of the embodiments according to FIGS. 5–8 it is provided in other contemplated embodiments of the invention that the outer surfaces of the friction rollers 1, 2 and 28 or the inner surfaces of the friction rollers 17 and 30 are provided at least in the region of the yarn formation zone with an upper surface texture formed as micro grooves which extend uniformly over the entire surface. In these embodiments separate strips of textured areas and non-textured areas (as shown and described with respect to FIGS. 5-8) would be replaced by texturing of the entire surface.

In practical embodiments it is advantageous if the upper surface texture of the friction rollers is again restored after a certain operational time. FIG. 9 illustrates an embodiment of a device by means of which the upper surface texture of the friction rollers 1 and 2 of the device according to FIGS. 1 and 2 can be renewed or restored. A travelling maintenance device 33 is adjustably positioned adjacent the friction rollers 1 and 2 and exhibits a corresponding treatment device 32. A handling or treatment head 34 is arranged on a pivot or swinging transverse arm 35 and includes a rapidly rotating brush 36 and a polishing wheel or roller 37. The rotational axes of the brush 36 and the polishing wheel 37 extend perpendicular to the longitudinal axis of the friction rollers 1 and 2. The treatment head 34, along with the rotating brush 36 and polishing wheel 37, is moveable back-and-forth in the directions of the arrows E and F in the longitudinal direction of the friction rollers 1 and 2. As can be seen from FIG. 10, the polishing wheel 37 is provided with a contour 40 which conforms to the cover surface of the friction rollers 1 and 2. In order to achieve the desired longitudinal orientation of the resulting upper surface texture in the form of microchannels extending in the longitudinal direction by means of the brush 36 and the polishing wheel 37, it is important that the treatment head 34 is moveable rapidly along the outer cover surface of rollers 1 and 2 in relation to the rotational speed of the friction rollers 1 and 2.

In a modification of the above described embodiments it is provided that the travelling maintenance device 33 is equipped with a rod 39 which is moveable in the arrow direction G and is provided with lifting rollers 38 by means of which the tangential belt 16 may be lifted off the friction rollers 1 and 2 while the upper surface texture is created. In a not further illustrated manner the maintenance unit 33 is provided with an auxiliary drive for the friction rollers 1 and 2 by means of which the friction rollers 1 and 2 can be step-wise rotated after an upwards or downwards movement of the corresponding brush 36 and/or polishing wheel 37, performing a treatment. Thereby it is possible to form an upper surface texture which is aligned exactly parallel to the longitudinal axes of the rollers 1 and 2.

In a corresponding manner as described above with respect to FIGS. 9 and 10, the inside surface of the cover of a friction roller 17 may be treated with the device corresponding to FIG. 11. In this device there is provided a handling disk or wheel such as a grinding disk or polishing disk 42 or the like, which has a circumferential surface corresponding to the inside contour of the friction roller 17 and which is arranged at an arm 41 which is guidably moveable into the inside of the friction roller 17. The arm is moveable in the direction of the arrows E and F, i.e. in a longitudinal direction of the friction roller 17, during the rotation of the treatment disk 42.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Friction roller construction for open-end friction spinning device of the type having a roller yarn forming cover surface portion that imparts friction to fibers and forming yarn in a yarn formation zone, said yarn forming surface portion exhibiting an outer surface texture which includes a plurality of microchannels extending essentially in the longitudinal direction of the roller over a substantial length of the roller.

2. Friction roller construction for open-end friction spinning device of the type having a roller yarn forming cover surface portion that imparts friction to fibers and forming yarn in a yarn formation zone, said yarn forming surface portion exhibiting an outer surface texture which extends essentially in a longitudinal direction of the friction roller, wherein said outer surface texture is formed by a plurality of microchannels extending essentially in the longitudinal direction of the roller.

3. Friction roller construction according to claim 1, wherein said microchannels are shaped in the form of a spiral extending at an acute angle with respect to the longitudinal axis of the roller.

4. Friction roller construction according to claim 2, wherein said microchannels are shaped in the form of a spiral extending at an acute angle with respect to the longitudinal axis of the roller.

5. Friction roller construction according to claim 2, wherein the microchannels are aligned parallel to the longitudinal axis of the roller.

6. Friction roller construction according to claim 2, wherein the microchannels are constructed in the form of adjacent parallel strips that are separated by intermediate non-textured regions.

7. Friction roller construction according to claim 1, wherein the entire yarn forming surface portion of the yarn formation zone of the roller is textured.

8. Friction roller construction according to claim 2, wherein the yarn forming cover surface portion is located on a radially outward facing surface of the friction roller.

9. Friction roller construction according to claim 2, wherein the yarn forming cover surface portion is located on a radially inwardly facing surface of a hollow friction roller.

10. Friction roller construction according to claim 4, wherein said acute angle is no greater than 30°.

11. Friction roller construction according to claim 1, wherein the plurality of microchannels extend essentially in the longitudinal direction of the roller over the entire length of the roller.

12. Friction roller construction according to claim 1, wherein the microchannels are aligned parallel to the longitudinal axis of the roller.

13. Friction roller construction according to claim 1, wherein the microchannels are constructed in the form of adjacent parallel strips that are separated by intermediate non-textured regions.

14. Friction roller construction according to claim 1, wherein the yarn forming cover surface portion is located on a radially outward facing surface of the friction roller.

15. Friction roller construction according to claim 1, wherein the yarn forming cover surface portion is located on a radially inwardly facing surface of a hollow friction roller.

16. Friction roller construction for open-end friction spinning device of the type having a roller yarn formimg cover surface portion that imparts friction to fibers and forming yarn in a yarn having a roller yarn forming formation zone, said yarn forming surface portion exhibiting an outer surface texture which extends essentially in a longitudinal direction of the friction roller, wherein the outer surface texture is aligned parallel to the longitudinal axis of the roller.

17. Friction roller construction for open-end friction spinning device of the type having a roller yarn forming cover surface portion that imparts friction to fibers and forming yarn in a yarn formation zone, said yarn forming surface portion exhibiting an outer surface texture which extends essentially in a longitudinal direction of the friction roller, wherein the outer surface texture is constructed in the form of adjacent parallel strips that are separated by intermediate non-textured regions.

* * * * *